US006318715B1

(12) United States Patent
Froechte et al.

(10) Patent No.: US 6,318,715 B1
(45) Date of Patent: Nov. 20, 2001

(54) DEVICE FOR SEPARATING SHEETS OF A RECORDING MEDIUM

(75) Inventors: Heinz Froechte, Zimmern; Ludwig Bantle, Boesingen, both of (DE)

(73) Assignee: BDT Buro-und Datentechnik GmbH & Co. KG, Rottweil (DE)

( * ) Notice: Subject to any disclaimer, the term of this patent is extended or adjusted under 35 U.S.C. 154(b) by 0 days.

(21) Appl. No.: 09/591,391

(22) Filed: Jun. 1, 2000

(30) Foreign Application Priority Data

Oct. 19, 1999 (DE) ..... 199 50 307

(51) Int. Cl.[7] ..... B65H 3/30; B65H 3/06; B65H 3/52

(52) U.S. Cl. ..... 271/117; 271/21; 271/121

(58) Field of Search ..... 271/21, 114, 117, 271/121, 137

(56) References Cited

U.S. PATENT DOCUMENTS 5,377,969 * 1/1995 Steinhilber ..... 271/21
5,620,269 * 4/1997 Gustafson ..... 400/624 X
5,755,433 * 5/1998 Klein ..... 271/2 X
6,139,007 * 10/2000 Cahill et al. ..... 271/121

FOREIGN PATENT DOCUMENTS 6 24579-6 * 6/1994 (JP) .

* cited by examiner

*Primary Examiner*—Christopher P. Ellis
*Assistant Examiner*—Kenneth W Bower
(74) *Attorney, Agent, or Firm*—Foley & Lardner; Bernard L. Kleinke

(57) ABSTRACT

A device for separating sheets (10) of a recording medium stored in a horizontally disposed stack includes an advance roller (16) resting on the stack and following the decreasing height of the stack. The advance roller (16) is drivable in order to acquire the topmost sheet (10.1) of the stack under frictional closure and to slide it for separation with its leading edge up on an obliquity (14). In order to be able to separate sheets (10) of different stiffness, the advance roller (16), while it is driven on the topmost sheet (10.1), drifts from the obliquity (14) until the leading edge of the sheet (10.1) runs up on the obliquity (14). The advance roller (16) is movable vertically. The counter force acting during the driving of the advance roller (16) is additionally supported in a rocker in order to increase the contact pressure against the topmost sheet (10.1) in case of the sheets of great stiffness.

9 Claims, 6 Drawing Sheets

Figure 1:
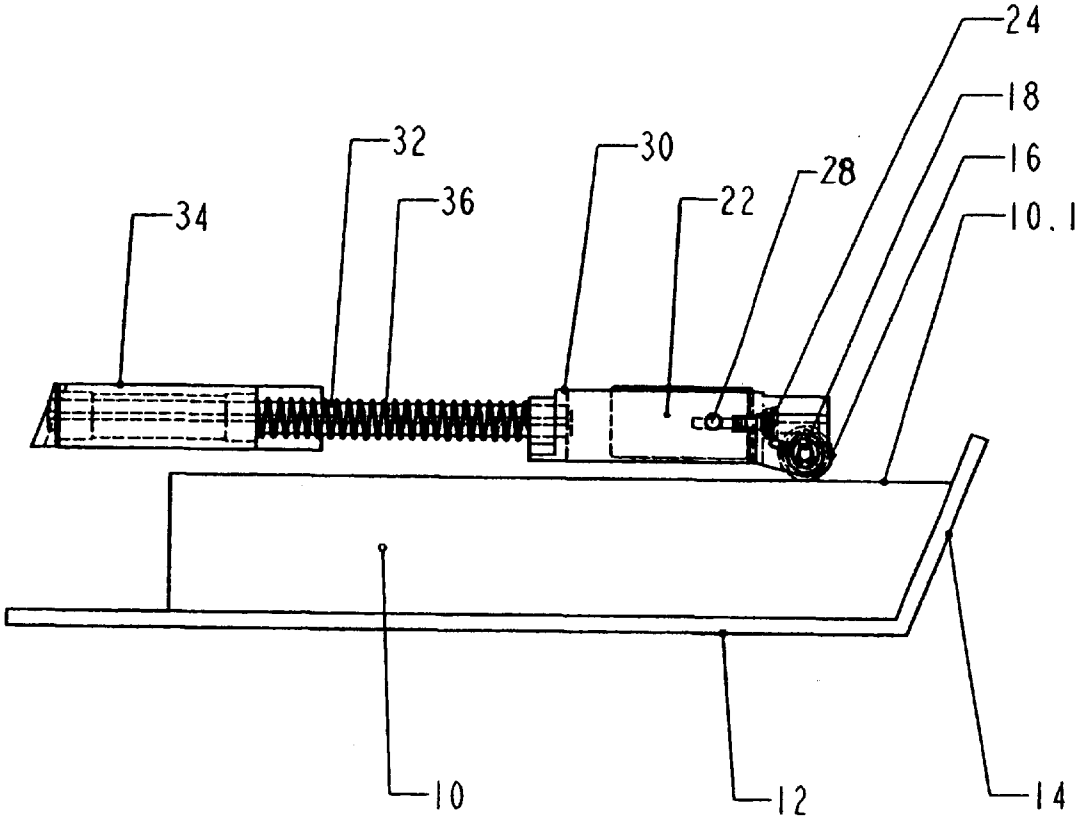

DETAIL Y
3:1

DETAIL X
3:1

DEVICE FOR SEPARATING SHEETS OF A RECORDING MEDIUM

The invention relates to a device for isolating sheets of a recording medium according to the preamble of claim 1.

A device of this class is known from EP 0 534 245 B1 (corresponding to U.S. Pat. No. 5,377,969). This known device serves for feeding sheets stored in a stack, of a recording medium to a business machine, for example a printer, a copier or the like. The stack is disposed substantially horizontally. A drivable advance roller is in contact on the topmost sheet of the stack and is movably supported such that it can follow the height of the stack decreasing according to the output of the sheets. The advance roller engages frictionally the topmost sheet of the stack and slides it with its leading edge against an increasing obliquity adjoining the stack, which leads to the business machine. The leading edge of the topmost sheet runs up on this obliquity whereby the topmost sheet is lifted from the succeeding sheets of the stack and is isolated. In order for the leading edge of the topmost sheet to be able to run up on the obliquity, the leading edge must be bent up relative to the plane of the sheet. Since this bending-up depends on the stiffness of the sheet, the advance roller while it is being driven on this topmost sheet can move away from the obliquity. The advance roller in this way removes itself automatically according to the stiffness of the sheet as far from the obliquity such that the leading edge of the sheet is flexed under the effect of the advance force of the advance roller and can run up on the obliquity. The device thus adapts automatically to the stiffness of the sheets of the particular paper type used. While the known device has been found to be outstandingly well suited for the paper types customarily used for business machines, difficulties are encountered if an especially thin paper is used or if a paper of greater weight and thus greater stiffness is used. In the case of thin papers a problem lies therein that the pressure exerted by the advance roller resting in contact on the topmost sheet generates friction between the topmost sheet and the second sheet of the stack, which can lead to the undesirable dragging of the second sheet during the isolation of the top most sheet. In the case of sheets of high stiffness the advance force through the friction transferred from the advance roller onto the topmost sheet may in some cases not be sufficient to bend the sheet up and to push the leading edge up on the obliquity.

The invention is based on the task of improving a device of the class cited in the introduction such that a reliable isolation is possible for a relatively large range of paper types.

This task is solved according to the invention through a device with the characteristics of claim 1.

Advantageous embodiments and further developments of the invention are specified in the dependent claims.

The essential idea of the invention comprises supporting the advance roller vertically freely movable such that it rests freely on the topmost sheet of the stack and can follow the decreasing height of the stack. If the advance roller is driven, it engages with frictional closure the topmost sheet of the stack in order to slide it in the advance direction. Initially the leading edge of the sheet is retained on the increasing obliquity since the stiffness of the sheet prevents the leading edge of the sheet from flexing and turning out upwardly in order to run up on the obliquity. While the topmost sheet is still retained in this way on the stack, the advance roller, due to its advance force which acts with frictional closure onto the topmost sheet, is moved away from the obliquity. The counter force, which moves the advance roller away from the obliquity, directed oppositely to the advance force causes, in addition, the vertical movement of the advance roller to be blocked. As soon as the advance roller is driven, it is consequently no longer freely vertically movable but is retained in its vertical position in which it rests on the topmost sheet.

This yields the advantage that the advance roller only needs to rest with a low weight on the stack. This low resting weight can be determined such that the contact pressure caused by this weight of the topmost sheet of the stack against the succeeding second sheet is low and no interfering friction between the topmost sheet and the succeeding second sheet of the stack occurs which might lead to the undesirable dragging of the second sheet during the advance of the topmost sheet. The device is thus suitable in particular also for the isolation of sheets of very thin paper. On the other hand, blocking of the vertical movability of the advance roller brings about as a result that the advance roller in spite of its low resting weight, is held firmly on the surface of the topmost sheet and during the driving cannot turn out from the surface of the topmost sheet upwardly. The advance force of the advance roller can therefore act unweakened with frictional closure onto the topmost sheet. It is thereby possible to isolate even sheets with great stiffness. Since through the measure according to the invention the isolation of sheets of a very thin paper with low stiffness as well as also the isolation of sheets of a paper of very high stiffness is promoted, the range of paper types, which can reliably be isolated, is considerably broadened.

The free vertical movability of the advance rollers is preferably realized thereby that the advance roller is supported on the free end of an arm with this free end of the arm being vertically movable. The arm is preferably pivotably supported in order to make possible the vertical movement of its free end. A special space-saving solution is obtained thereby that the arm is supported laterally of the stack and with its free end projects from the side over the stack. It is also possible to support the arm above the stack. An above the stack supported arm can also be telescopically longitudinally variable in order to permit a vertical movement of the advance roller disposed at its free end.

In a preferred embodiment the arm bearing the advance roller is relieved through a spring force which at least partially compensates the weight of the arm and of the advance roller. Through the dimensioning of this spring force the resting weight, and thus the resting pressure of the advance roller on the topmost sheet, can be freely selected and defined. It is in particular possible thereby to allow to rest the advance roller with an extremely low resting weight of, for example, only 50 to 100 g on the stack. Thereby only a very low friction between the topmost sheet and the succeeding second sheet of the stack is generated. The blocking of the vertical movement of the roller during the driving and during the advance ensures even with such a low resting weight a reliable frictional closure between advance roller and the topmost sheet. In a constructionally simple way the blocking of the vertical movement of the advance roller is brought about thereby that the counter force acting onto the advance roller is directed at least with one force component transversely to the movement of the arm bearing the advance roller and thereby causes a clamping of the movement of the arm.

The advance roller moves away from the obliquity preferably against the force of a reset spring. The reset spring causes at least that the advance roller is again reset toward the obliquity when the topmost sheet has been isolated and pulled from the stack, such that the advance roller rests on the succeeding next sheet of the stack. The reset spring preferably has an increasing spring characteristic such that the reset force increases with increasing distance of the advance roller from the obliquity. Thereby the path which the advance roller must travel in the case of sheets of relatively great stiffness until the leading edge of the sheet bends up and can run up on the obliquity, is not increased strongly.

In a further development the advance roller is not only movable against a reset spring but additionally also supported in a rocker, through which the angle of attack of the advance roller against the surface of the topmost sheet is changed. If the advance roller on the topmost sheet of the stack is moved away from the obliquity against the force of the reset spring, the rocker under the effect of the spring force of the reset spring is positioned more steeply against the surface of the topmost sheet whereby the pressing force of the advance roller against the sheet surface is increased. Thereby with sheets of relatively great stiffness the friction and the advance force transferred onto the topmost sheet is additionally augmented in order to isolate reliably sheets of relatively great stiffness. Through this measure the range of paper types which can be isolated can be additionally expanded toward greater paper weights and greater stiffness.

In a preferred support of the advance roller on an arm projecting from the side over the stack, the pivot plane of the arm is preferably disposed parallel to the plane of the obliquity. Thereby the advance roller pivots with decreasing stack height parallel to the obliquity such that the distance between the obliquity and the advance roller stays constant in terms of its basic position independently of the stack height.

In this embodiment, further, the arm is developed as double arm with two parallel arms. These parallel arms permits the exact parallel guidance of the advance roller during the movement on the stack.

Through the reduction of the resting weight of the advance roller on the stack and through the blocking of the vertical movement of the advance roller during the advance, the range of paper types which can be isolated reliably, can be expanded toward lesser paper weights and thus a lesser stiffness as well as also toward greater paper weights and thus a greater stiffness. A range from approximately 45 g/m$^2$ to 300 g/m$^2$ can be covered.

Figure 2:
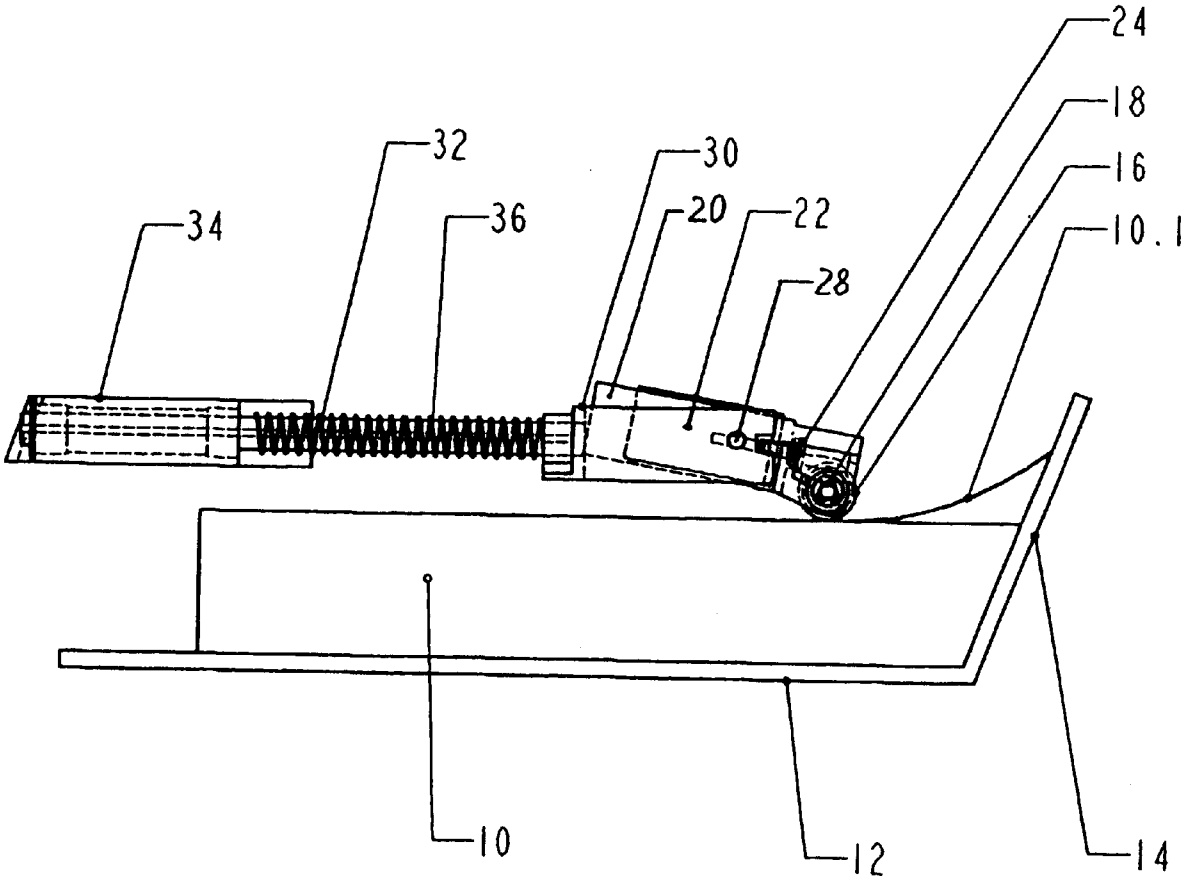
Figure 3:
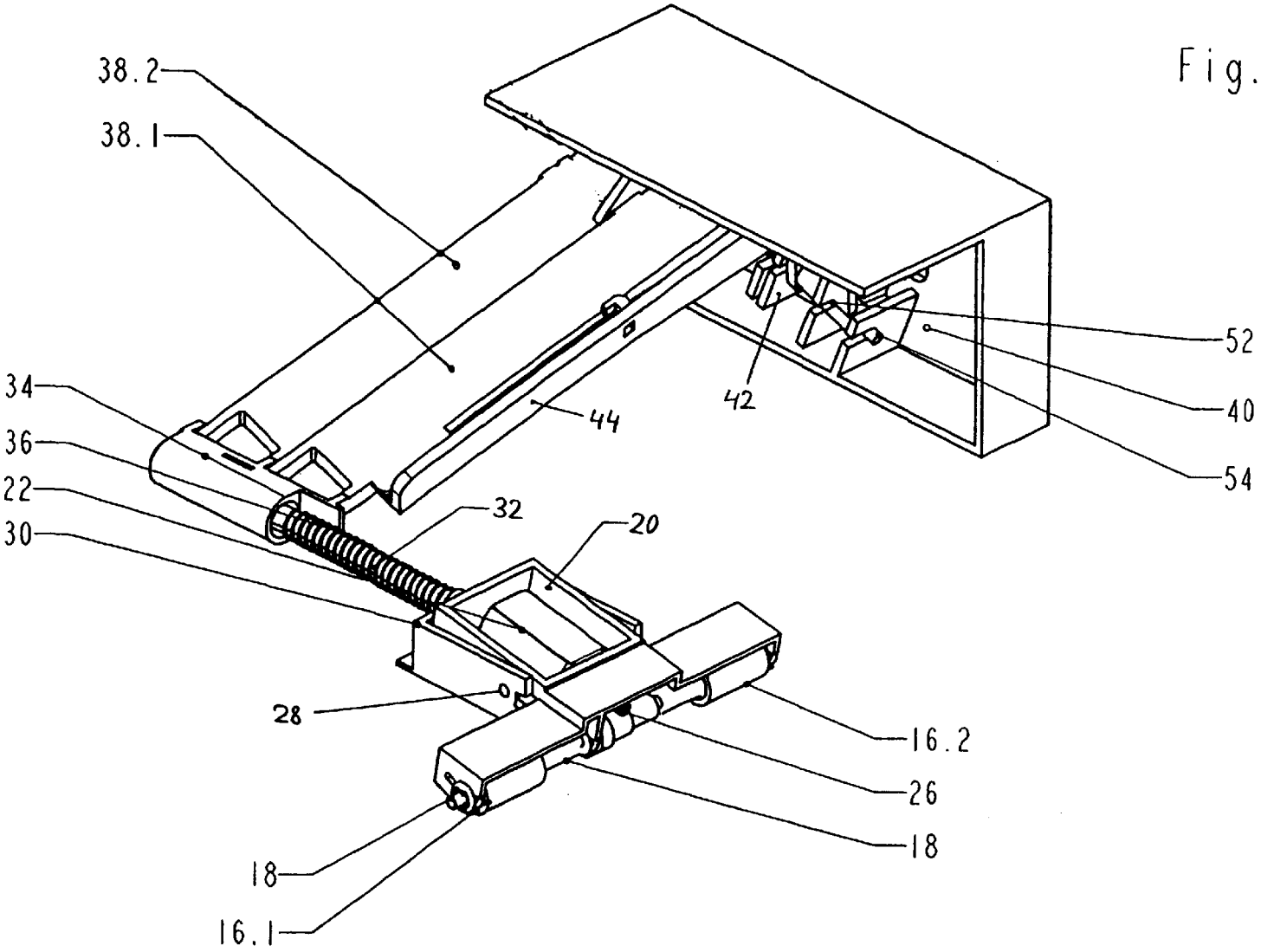
Figure 4:
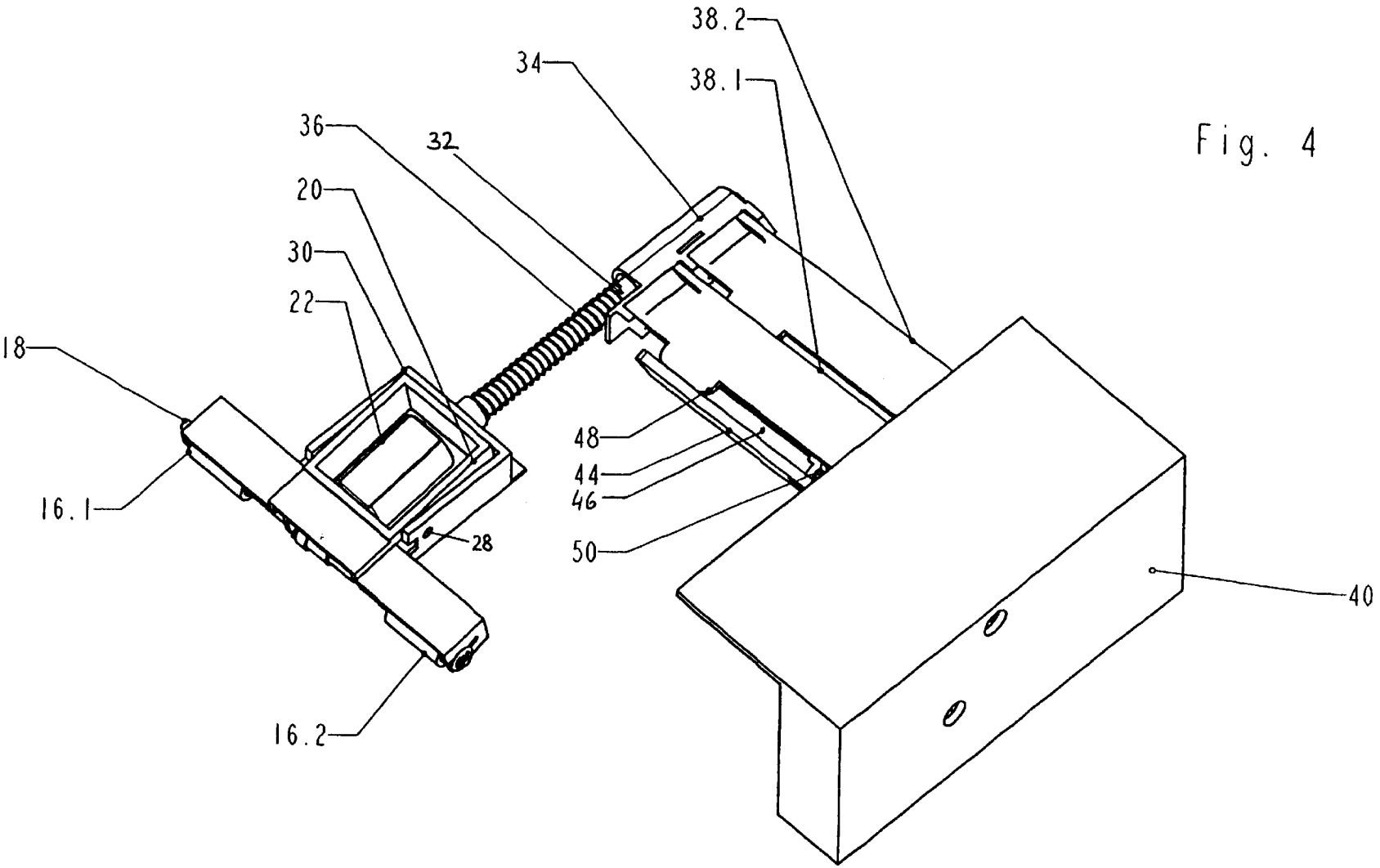
Figure 5:
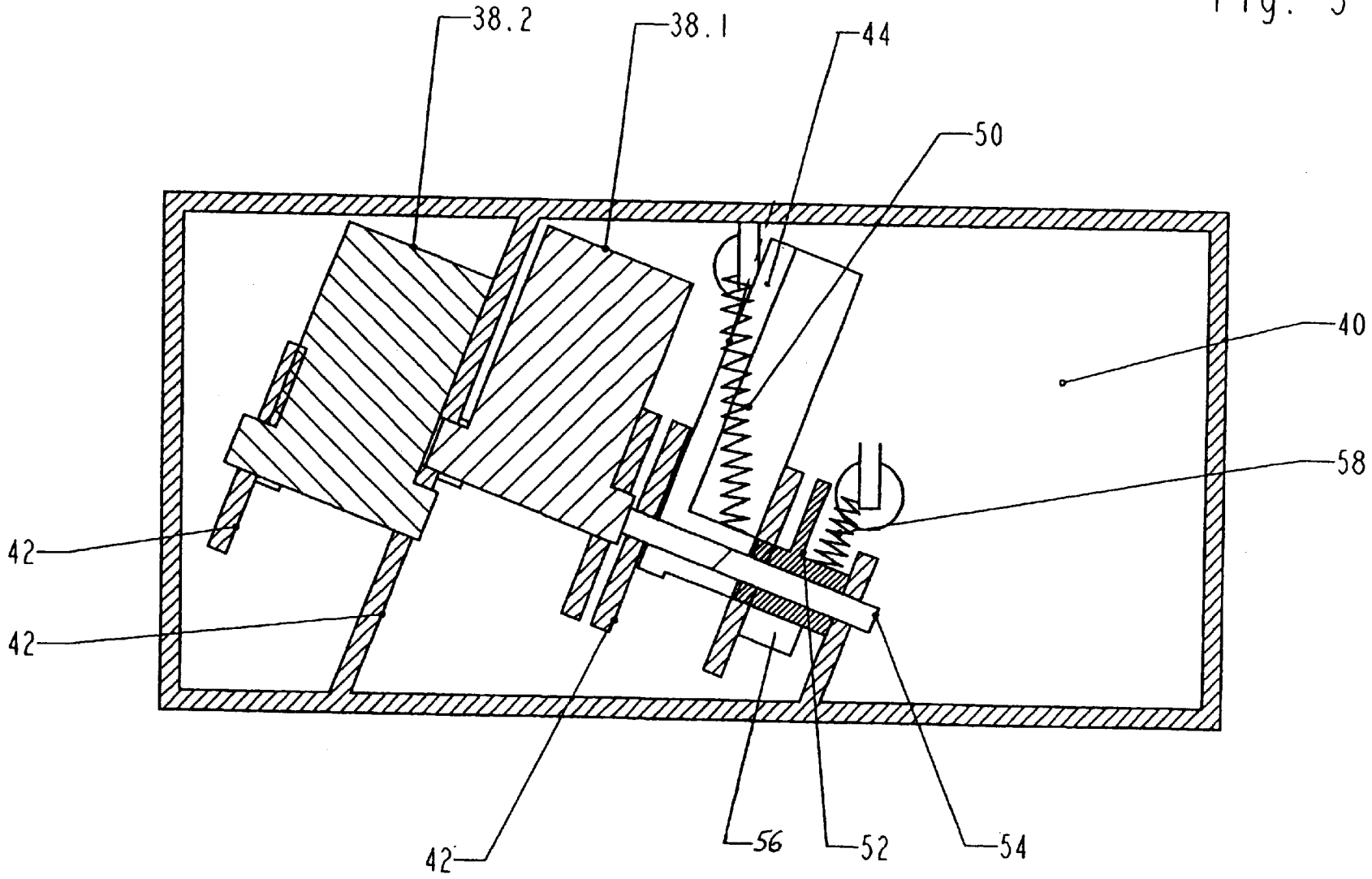
Figure 7:
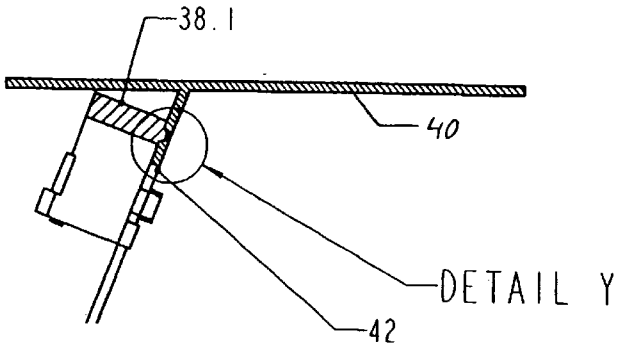
Figure 7:
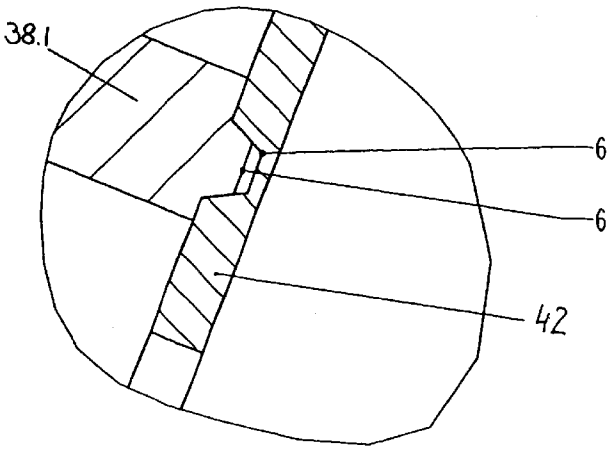
Figure 6:
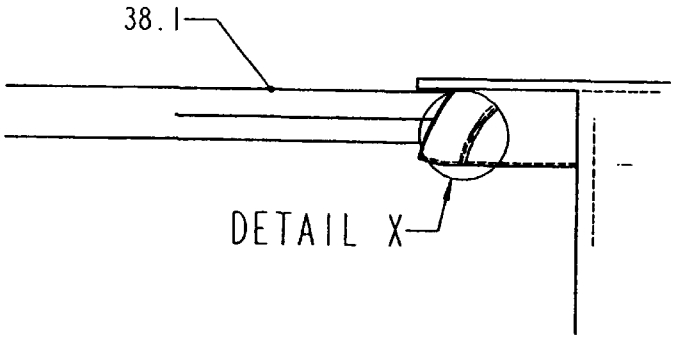
Figure 6:
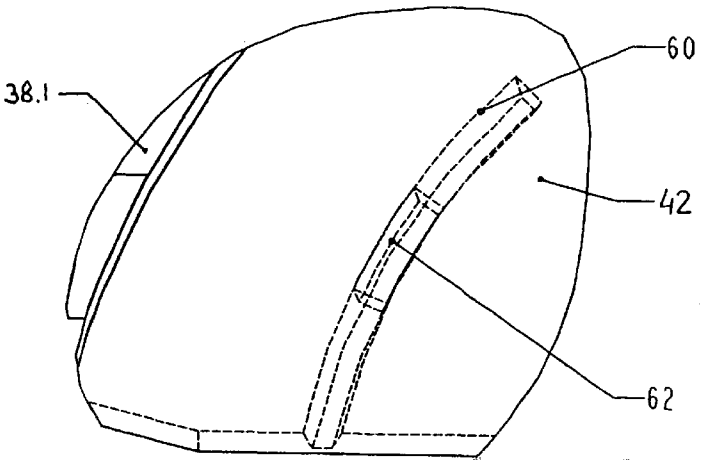

In the following the invention will be explained in further detail in conjunction with an embodiment example depicted in the drawing. Therein show:

FIG. 1 schematically a vertical section through the device in the resting position, FIG. 2 a representation corresponding to FIG. 1 of the device in the isolating position, FIG. 3 a perspective view of the device, FIG. 4 a view of the device from above, FIG. 5 a view of a lateral load-bearing wall of the device, FIG. 6 in a detailed representation the clamping of the device, and FIG. 7 a view rotated by 90° of the clamping of FIG. 6.

The device depicted in the drawing serves for feeding individual sheets of a recording medium, in particular of paper sheets, to a business machine, for example to a printer or a copier.

The sheets 10 are provided as a stack preferably stored in a tray for the feeding to the business machine. The stack of sheets 10 is in contact on a horizontal bottom 12 of the tray. On the front edge of the tray from the bottom 12 a wall developed as obliquity 14 leads upwardly to a sheet acceptance, not shown in the drawing, of the business machine. The obliquity 14 is inclined relative to the perpendicular to the bottom 12 by approximately 21° to 25°. The stacked sheets 10 are in contact with their leading edge on the obliquity 14.

In order to isolate the sheets 10 from the stack and to feed them to the business machine, on the topmost sheet 10.1 rests an advance roller 16 which is drivable and with its circumference engages the sheet 10.1 with frictional closure. If the advance roller 16 is driven (in FIGS. 1 and 2 in the counterclockwise direction), it slides the topmost sheet 10.1 with its leading edge against the obliquity 14. The leading edge of sheet 10.1 bends up and is raised from the stack of the succeeding sheets and isolated, as is shown in FIG. 2. The sheet 10.1 is pushed up through the advance roller 16 with its leading edge ahead further on the obliquity 14 and arrives in the sheet acceptance of the business machine which brings about the further transport of sheet 10.1 and pulls it away from under the advance roller 16, which is equipped with an overriding free-wheel such that it does not hinder the pulling-off of the sheet 10.1.

In FIGS. 3 and 4 the mounting and operating function of the advance roller 16 is evident in detail. The advance roller 16 preferably comprises two individual rollers 16.1 and 16.2 which reside on a common shaft 18 and comprise a frictional-quality adhesive shell with which they reside on the topmost sheet 10.1 of the stack and engage this sheet 10.1. The shaft 18 is disposed horizontally and parallel to the obliquity 14 such that the advance roller 16 slides the topmost sheet 10.1 with its leading edge against the obliquity 14 without tipping. The shaft 18 is rotatably supported in a rectangular frame-form rocker 20. The rocker 20 extends from its end mounting the shaft 18 in the direction facing away from the obliquity 14. In the rocker 20 is fastened a controllable electro motor 22 whose shaft engages via a worm gear drive 26 the shaft 18 of the advance roller 16 such that the advance roller 16 can be driven by means of the electro motor 22.

The rocker 20 is supported in a U-form frame 30, pivotably about an axis 28 parallel to shaft 18 of the advance roller 16. The rocker 20 bearing the advance roller 16 can be tilted from the position shown in FIG. 1, in which the rocker 20 is horizontal in the frame 30 disposed horizontally, into a position shown in FIG. 2, in which the advance roller 16 is lowered downwardly and the rocker 20 assumes relative to the horizontal frame 30 a maximum angle of 30° to 45°.

The frame 30 is fastened on the front end of a guidance rod 32 disposed horizontally in the sheet advance direction. The guidance rod 32 is supported slidingly on its axis in a guidance block 34. On the guidance rod 32 resides a reset spring 36 developed as helical compression spring, which is braced at one end on the frame 30 and, on the other end, on the guidance block 34. The isolation head formed of the advance roller 16, the rocker 20, the electro motor 22 and the frame 30, can move against the force of the reset spring 36 away from the obliquity 14 toward the guidance block 34. The guidance of the guidance rod 32 in the guidance block 34 therein brings about that the frame 32 [sic: 30] is guided horizontally and that the shaft 18 of the advance roller 16 remains parallel to the obliquity 14. The characteristic of the reset spring 36 brings about that the reset force acting onto the isolation head increases the further the advance roller 16 moves away from the obliquity 14.

The guidance block 34 is articulated on an arm 38 which, developed as a double arm, comprises a front arm 38.1 and a rear arm 38.2. The front arm 38.1 and the rear arm 38.2 are supported pivotably on a load-bearing wall 40. The load-bearing wall 40 is disposed vertically and extends along a side edge of the device and thus parallel to the side edges of the stacked sheets 10. The load-bearing wall 40 is mounted laterally of the receiving space into which the tray receiving the stack of sheets 10 is set.

Through the pivotable mounting of the two arms 38.1 and 38.2 on the load-bearing wall 40 and the articulation of the guidance block 34 on the free ends of these two arms 38.1 and 38.2 a parallelogram guidance results of the guidance block 34 and the guidance rod 32 guided axially in it. Due to this parallelogram guidance during a pivoting of the arms 38.1 and 38.2 the guidance rod 32 guided in the guidance block 34 moves axis parallel upwardly or downwardly.

On the load-bearing wall 40 the arms 38.1 and 38.2 are supported pivotably between guidance webs 42. As is evident in particular in FIG. 5, the guidance webs 42 are inclined relative to the vertical at the same angle of approximately 21° to 25° as the obliquity 14. During the pivoting of arms 38.1 and 38.2 these arms thus move, due to the guidance webs 42, in the pivot planes which extend parallel to the plane of the obliquity 14. Accordingly the guidance block 34 also moves during the pivoting of arms 38.1 and 38.2 with constant horizontal interval from obliquity 14. Thereby the advance roller 16 has in its basic position depicted in FIG. 1 with the reset spring 36 not compressed, always a constant interval from the obliquity 14 independently of the pivot position of arms 38.1 and 38.2. Through the pivoting of arms 38.1 and 38.2 the advance roller 16 can always rest on the topmost sheet 10.1 of the stack of sheets 10, independently of the height of the stack or the number of sheets 10 contained in the stack. The interval between the leading edge in contact on the obliquity 14 of the topmost sheet 10.1 and the resting line of the advance roller 16 on this sheet 10.1 in the basic position, consequently, is independent of the height of the stack.

In order to reduce the resting pressure of the advance roller onto the topmost sheet 10.1 of the stack, on the lateral load-bearing wall 40 further a lifting arm 44 is supported. The lifting arm 44 is disposed adjoining on the front edge of the front arm 38.1 and is pivotable parallel to the pivot plane of the front arm 38.1. The lifting arm 44 reaches with its lower edge 46 under a lateral projection 48 of the front arm 38.1. The lifting arm 44 is engaged by a tension spring 50 fastened on the load-bearing wall 40 which prestresses the lifting arm 44 upwardly in the pivot direction. The force of the tension spring 50 consequently acts counter to the weight of arm 38 and of the isolating head supported on this arm 38 and largely compensates this weight. It is thereby achieved that the advance roller 16 rests only with a low resting weight of, for example, 50 g to maximally 100 g on the stack of sheets 10.

Further is disposed on the load-bearing wall 40 a lifting lever 52 which is pivotable about an axis 54 parallel to the load-bearing wall 40. The lifting lever 52 reaches with an arm projecting upwardly under the lifting arm 44 while a lower thrust arm 56 of the lifting lever 52 projects into the receiving space for the tray receiving the sheets 10. A tension spring 58 engages with one end the upper arm of the lifting lever 52 and is fastened with its other end on the load-bearing wall 40.

If a tray with a stack of sheets 10 is set into the device, this tray is in contact with its side wall on the load-bearing wall 40. The tray presses the thrust arm 56 against the load-bearing wall 40 whereby the lifting lever 52 is pivoted against the force of the tension spring 58. The upper arm of the lifting lever 52 is therefore pivoted by the lifting arm 44 downwardly such that the lifting arm 44, and thus the arm 38, is released from the lifting lever 52 and can be vertically pivoted unhindered such that the advance roller 16 rest on the sheet stack and can follow the height of the sheet stack. If the tray is to be removed from the device, for example to replenish sheets 10 or to replace them by another sheet type, the tray is first pulled away from the load-bearing wall 40. Thereby the lower thrust arm 46 of the lifting lever 52 is released from the side wall of the tray and the tension spring 58 can pivot the lifting lever 52. The lifting lever 52 now engages with its upper arm from below the lifting arm 44 and, under the effect of the tension spring 58, raises the lifting arm 44 upwardly, wherein the lifting arm 44 takes along the front arm 38.1 resting on it and this front arm 38.1, in turn, takes along the guidance block 34 and the rear arm 38.2. The arm 38 and with this the isolation head are consequently pivoted upwardly by means of the lifting lever 52 and the tension spring 58, such that the tray can be pulled out of the device in the direction of arm 38 without hindrance and subsequently can again be slid into it.

As shown in FIGS. 6 and 7, on one of the guidance webs 42 is developed a clamping groove 60. The clamping groove 60 is developed on the side face toward one arm, for example the front arm 38.1, of the guidance web 42 and extends in the vertical direction in a circular arc corresponding to the radius of the pivot movement of this arm 38.1, as is shown in FIG. 6. Onto the side edge, toward the clamping groove 60, of the front arm 38.1 is formed a clamping peg 62 which engages the clamping groove 60. The cross sectional profile of the clamping groove 60 tapers in the form of a wedge opposing the groove bottom. The clamping peg 62 is developed conically corresponding to the wedge angle of the cross sectional profile of the clamping groove 60. The clamping peg 62 projects with slight lateral play into the clamping groove 60. The clamping peg 62 thus is not in contact with the wall of the clamping groove 60 and moves freely in this clamping groove 60 when the arm 38.1 is pivoted.

If, however, onto the front arm 38.1 a force acts perpendicularly to the pivot plane of arm 38.1, then, due to the bearing play of arm 38.1, this arm 38.1 is pressed slightly backwardly and the clamping peg 62 comes into contact with the clamping groove 60 and due to the wedge form becomes clamped in the clamping groove 60. The pivot movement of the front arm 38.1, and thus also the arm 38.2 coupled with this, is thereby suddenly blocked as soon as a slight force acts onto the arm 38 in the direction of the guidance rod 32.

In the following the operating function of the device will be explained:

In the basic position, shown in FIG. 1, the isolation head with the advance roller 16 rests on the topmost sheet 10.1 of the stack. The resting pressure of the advance roller 16 is low since the weight of arm 38 and of the isolation head is relieved and compensated by means of the lifting arm 44 through the tension spring 50. The arm 38 is vertically freely pivotable such that the isolation head with the advance roller 16 can follow the height of the stack of sheets 10 and the advance roller 16 rests on this stack independently of the height of the stack of sheets 10.

The reset spring 36 slides the advance head [sic] into its final position pushed forward. Since the arm 38 is pivoted parallel to the plane of the obliquity 14, the resting line of the advance roller 16 is always disposed, independently of the stack height, at the same interval from the front edge, in contact on the obliquity 14, of the topmost sheet 10.1. The advance roller 16 is not driven and rests stationary on the topmost sheet 10.1.

If a sheet is to be fed after isolation to the business machine, then, upon a corresponding command signal, the electro motor 22 is activated and drives the advance roller 16 (in the representation of FIGS. 1 and 2 in the counterclockwise direction). Since the advance roller 16 engages with frictional closure the topmost sheet 10.1, the advance roller 17 attempts to slide this sheet 10.1 against the obliquity 14. As long as the stiffness of the sheet 10.1 prevents a flexing of the sheet between the advance roller 16 and the obliquity 14, the leading edge of the sheet 10.1 cannot run up on the obliquity and the sheet 10.1 is retained by the obliquity 14. The driving of roller [sic] 16 brings about that it rolls on the topmost sheet 10.1 away from the obliquity 14 (in FIGS. 1 and 2 toward the left). The advance roller 16 slides thereby, via the rocker 20 and the frame 30, the guidance rod 32 in the guidance block 34 toward the left, whereby is compressed the reset spring 36. The pressure of the reset spring 36 acts via the guidance block 34 onto arm 38. Thereby the front arm 38.1 with its clamping peg 62 is pressed into the clamping groove 60 such that the pivot movement of arm 38 is blocked immediately at the start of the driving of the advance roller 16. The guidance block 34 and the guidance rod 32 guided in it with the frame 30 are thereby retained in their height position and at their interval above the topmost sheet 10.1 of the stack.

While the advance roller 16 rolls on the topmost sheet 10.1 away from the obliquity 14, the interval of the engagement line of the advance roller 16 from the leading edge of sheet 10.1 in contact on the obliquity 14 increases. Simultaneously the advance force exerted by the advance roller 16 onto the sheet 10.1 increases since to the advance force generated by the torque of the advance roller 16 the spring force of the reset spring 36 is added which increases with increasing displacement path of the advance roller 16. The advance roller moves so far away from the obliquity 14 until the increasing advance force acting onto the topmost sheet 10.1, on the one hand, and the interval of the engagement line of the advance roller 16 from the leading edge in contact on the obliquity 14, of sheet 10.1, on the other hand, have increased so far that as a function of the stiffness of sheet 10.1 its leading edge can bend up and run up on the obliquity 14. Now, the advance roller 16 slides the topmost sheet 10.1 up on the obliquity 14 until its leading edge is grasped by the acceptance mechanism of the business machine and is transported further. Since the sheet 10.1 no longer counteracts the advance force of the advance roller 16 , the advance roller 16, under the effect of the reset spring 36, can again move back into the basic position shown in FIG. 1. An overriding free-wheel of the advance roller 16 permits therein that the sheet 10.1 is pulled away from under the advance roller 16 through the acceptance of the business machine. The driving of the advance roller 16 is switched off such that the advance roller stands still when the topmost sheet 10.1 has been completely pulled away from under the advance roller 16. The advance roller 16 subsequently rests again in the basic position shown in FIG. 1 on the succeeding second sheet 10 of the stack and the device is again in the basic position and is ready for the feeding of the next sheet.

A further advantage results thereby that the advance roller 16 is supported in the pivotable rocker 20. When the advance roller 16 is driven such that is rolls on the topmost sheet 10.1 away from the obliquity 14 (in FIGS. 1 and 2 toward the left), the counter force directed opposite to the driving which moves the advance roller 16 toward the left, causes a torque onto the rocker 20 through which it [the rocker] is tilted about its axis 28 in the counterclockwise direction, as is shown in FIG. 2. This torque acting onto the rocker 20 leads to the fact that the pressing roller [sic] 16 is pressed with greater force against the top sheet 10.1. The further the advance roller 16 moves away from the obliquity 14 and the stronger the reset force of the reset spring 36 increases, the more the contact pressure of the advance roller 16 against the topmost sheet 10.1 also increases thereby. This increase of the contact pressure of the advance roller 16, in turn, increases the friction between the advance roller 16 and the topmost sheet 10.1. In the case of greater stiffness with which the advance roller 16 moves further away from the obliquity 14, thereby additionally a progressive rise of the contact pressure of the advance roller 16 results and thus of the frictional closure between the advance roller 16 and the topmost sheet 10.1. This promotes the isolation in particular with sheets of greater weight and greater stiffness. Blocking of the pivot movement of arm 38 and thus of the guidance block 34 and the guidance rod 32 with the frame 30 leads to the counter bracing for this increasing contact pressure of the advance roller 16.

List of reference symbols

10 Sheets
10.1 Topmost sheet
12 Bottom
14 Obliquity
16 Advance roller
16.1 Advance roller
16.2 Advance roller
18 Shaft (of 16)
20 Rocker
22 Electro motor
24 Shaft (of 24)
26 Worm gear drive
28 Axis
30 Frame
32 Guidance rod
34 Guidance block
36 Reset spring
38 Arm
38.1 Front arm
38.2 Rear arm
40 Load-bearing wall
42 Guidance web
44 Lifting arm
46 Lower edge (of 44)
48 Projection (of 38.1)
50 Tension spring (of 44)
52 Lifting lever
54 Axis (of 52)
56 Thrust arm
58 Tension spring
60 Clamping groove
62 Clamping peg

What is claimed is:

1. Device for isolating sheets of a recording medium, in which the sheets are stored in a stack essentially disposed horizontally, with an advance roller resting on the stack and following the decreasing height of the stack, which is drivable in order to acquire the topmost sheet of the stack under frictional closure and to slide it for the purpose of isolation with its leading edge against an obliquity, adjoining the stack and rising relative to the sheet plane, wherein the advance roller, while it is being driven on the topmost sheet, moves away from the obliquity until the leading edge of the sheet runs up on the obliquity, characterized in that the advance roller (16) is supported vertically freely movably and that the counter force corresponding to the advance force onto the advance roller blocks the vertical movability of the advance roller (16).

2. Device for isolating sheets of a recording medium, in which the sheets are stored in a stack essentially disposed horizontally, with an advance roller resting on the stack and following the decreasing height of the stack, which is drivable in order to acquire the topmost sheet of the stack under frictional closure and to slide the topmost sheet for the purpose of isolation with its leading edge against an obliquity, adjoining the stack and rising relative to the sheet plane, wherein the advance roller, while being driven on the topmost sheet, moves away from the obliquity until the leading edge of the sheet runs up on the obliquity, characterized in that the advance roller (16) is supported vertically freely movably and that the counter force corresponding to the advance force onto the advance roller blocks the vertical movability of the advance roller (16), characterized in that the advance roller (16) is supported on the free end of an arm (38) which movably follows the height of the stack and that the movement of the arm (38) is blocked through the counter force.

3. Device as claimed in claim 2, characterized in that the resting force of the advance roller (16) caused by the weight of the arm (38) and the advance roller (16) on the topmost sheet (10.1) of the stack is at least partially compensated.

4. Device as claimed in claim 3, characterized in that the resting force is compensated through a spring force (50) which acts as a weight relief on the arm (38).

5. Device as claimed in claim 2, characterized in that the counter force acting onto the advance roller (16) comprises a force component which is directed transversely to the direction of movement of the arm (38) and causes a clamping of the movement of the arm (38).

6. Device as claimed in anyone of claims 1 to 5, characterized in that the advance roller (16) moves against the force of a reset spring (36) on the topmost sheet (10.1) away from the obliquity (14).

7. Device as claimed in claim 6, characterized in that the arm (38) is supported laterally from the stack of sheets (10) and projects transversely to the advance direction of the sheet (10) over the stack.

8. Device as claimed in claim 7, characterized in that the arm (38) is formed by two arms (38.1, 38.2) coupled with one another, which brings about a parallelogram guidance for the shifting of the advance roller (16).

9. Device as claimed in claim 6, characterized in that the advance roller (16) is supported in a rocker (20) which is tiltable about a horizontal axis (28) parallel to the shaft (18) of the advance roller (16) and guided horizontally against the force of the resting spring (36) away from the obliquity (14).

* * * * *